United States Patent [19]

Driscoll et al.

[11] 3,967,730

[45] July 6, 1976

[54] CIGARETTE PACKAGE

[75] Inventors: Frank E. Driscoll, Winston Salem; Richard S. Wimbish, Mount Airy, both of N.C.

[73] Assignee: Techform, Inc., Mount Airy, N.C.

[22] Filed: Jan. 28, 1975

[21] Appl. No.: 544,823

[52] U.S. Cl. ..... 206/461; 206/467; 206/470; 206/268

[51] Int. Cl.[2] ..... B65D 85/10; B65D 85/62

[58] Field of Search ..... 206/470, 471, 469, 467, 206/256, 268, 45.34, 462, 461, 443, 503

[56] References Cited

UNITED STATES PATENTS

| | | | |
|---|---|---|---|
| 2,874,836 | 2/1959 | Wertepny, Jr. | 206/471 |
| 3,174,621 | 3/1965 | Watson | 206/470 |
| 3,529,718 | 9/1970 | Zaremski | 206/469 |
| 3,732,663 | 5/1973 | Geldmacher | 206/256 |

*Primary Examiner*—William T. Dixson, Jr.

[57] ABSTRACT

A package for elongated elements, such as cigarettes, in which there is a supporting base on which a plastic blister form is secured forming an elongated chamber with closure means openable at one end for exposing contained elements in the package, and spaced reinforcing elements on the package to prevent crushing package contents.

5 Claims, 6 Drawing Figures

CIGARETTE PACKAGE

BACKGROUND, BRIEF DESCRIPTION AND ADVANTAGES OF INVENTION

Vacuum forming of various types of packages for enveloping hard and soft goods is well known and widely used for displaying various articles to consumers. Usually the blister packages are made of clear plastic enabling a purchaser to view the package contents. Once the package is purchased, the goods are removed and the package destroyed and discarded.

Cigarettes and cigars have conventionally been packaged in small paper wrapped containers with the compact packaging such that one element contacts the other and the closure, once opened, affords little or no protection to the remaining elements in the package.

It is an objective of this invention to provide a compact reusable package for elongated elements and particularly cigarettes or small cigars in which one element may be removed from a closure means of a vacuum formed blister package and reinserted through the closure means.

Another objective of this invention is to provide a novel blister package for elongated elements that may be readily opened and closed and one in which the packaged elements may be protected against crushing against normal forces of multiple packaging in shipment. Still another objective of this invention is to provide a vacuum formed blister package for cigarettes that is sealed from the air and may be viewed by the purchaser through a clear package that is reusable with the elements separated from each other and readily removed individually without disturbing another element in the same package.

Other objects and advantages of this invention will become more readily apparent from the following detailed description and drawings.

DRAWING DESCRIPTION

DETAILED DESCRIPTION OF INVENTION

Figure 1:
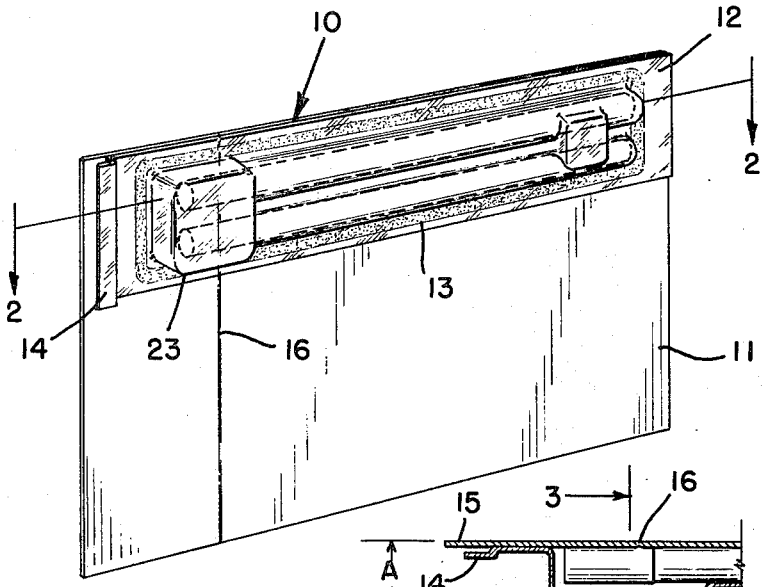
FIG. 1 is a front perspective view of a package for elongated elements embodying this invention with the elongated elements shown in outline form.

A preferred embodiment of the invention is shown in FIG. 1 for a package 10 for elongated elements which in the present description will be cigarettes or small cigars although the package may be used for other elongated elements. A rectangular cardboard base support member 11 on which may be printed appropriate advertising material and trademark logo at the lower portion thereof supports at the upper portion a vacuum formed blister member 12 of clear plastic which has a rectangular configuration in plan view.

The clear plastic blister form 12 is securely fastened by suitable means whether thermoplastic or other adhesive to the cardboard or paper base support 11 around the perimetrical flange 13 on the blister form with the bond there between forming an air seal in the sealed package.

One terminal end of the blister form is provided with an off set lip 14 that is spaced from the planar base support to facilitate separation of the lip 14 from the adjacent portion 15 of the base support. The base support is preferably provided with a score line 16 which serves as a hinge on the base support when the package is to be opened to remove one or more of the packaged elements as shown in FIG. 5.

Figure 2:
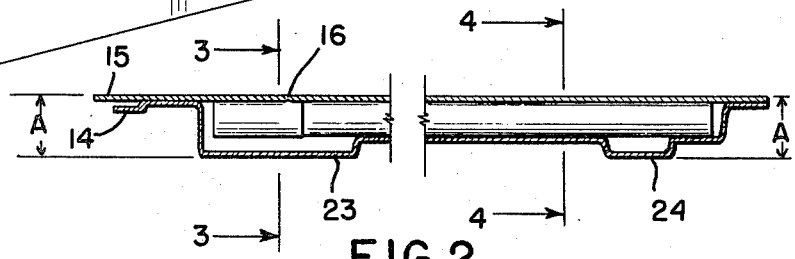
FIG. 2 is a partial transverse sectional view taken along section line 2—2 of FIG. 1.
Figure 3:
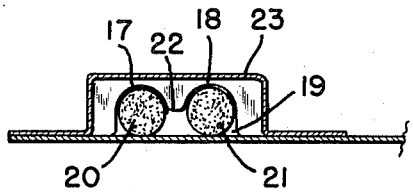
FIG. 3 is a partial transverse sectional view taken substantially along section line 3—3 of FIG. 2.
Figure 4:
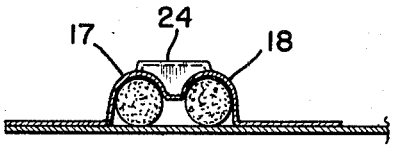
FIG. 4 is a partial transverse sectional view taken substantially along section line 4—4 of FIG. 2.

Blister form 12 is provided with laterally spaced-apart oval shaped elongated members 17 and 18 which form part of the chamber 19 in the package for retaining the elongated elements or cigarettes 20 and 21 in spaced relation within the package separated by the downwardly extending rib 22 in the blister form. An enlarged substantially rectangular housing 23 is formed in the blister form at 1 thereof which extends to a heighth higher than the arcuate form 17 and 18 of the other portions of the blister form. A smaller rectangular member 24 also extends to the same heighth A as member 23, as shown in FIG. 2 with elements 23 and 24 serving as reinforcing and spacing members to prevent crushing of the packaged elements in shipping and to provide increased reinforcement for the elongated sections 17 and 18 of the blister form 12. The longitudinal spacing between members 23 and 24 is such that adjacent packages may be positioned in nested arrangement without crushing in shipment or in stacking. Furthermore, the members 23 and 24 facilitate removal of the elongated elements through the closure.

Figure 5:
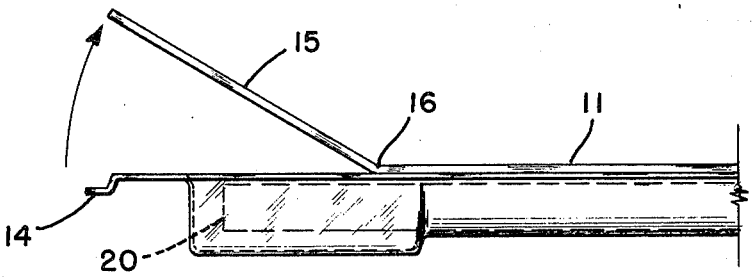
FIG. 5 is an enlarged partial side view illustrating one closure form in the open condition.
Figure 6:
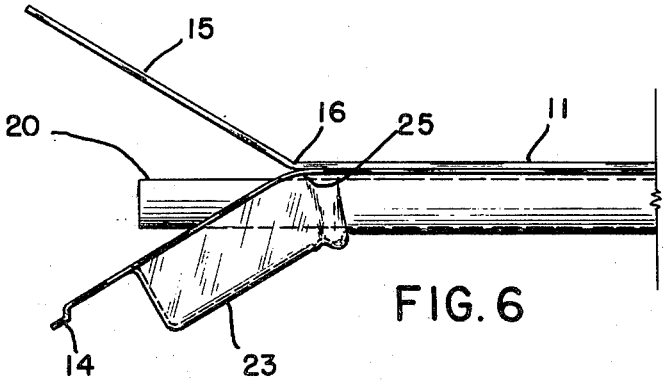
FIG. 6 is an enlarged partial side view of the package showing another form of the closure in which the elongated element is exposed for removal.

In FIG. 5, the hinged portion 15 of the base support is shown after the bond has been broken between the sealing member 13 with the blister pack enabling one to remove a cigarette 20 from within the package. Although the blister pack may only be a few mils in thickness and has sufficient flexibility, the cigarette may be removed quite readily, in some instances without folding back the blister package completely. However, as shown in FIG. 6, the portion of the base support 15 is folded back and a member 23 in the blister form is also flexed back by pivoting lip 14 so that the blister form will form a hinge at approximately the score line in the base support at the point 25 facilitating the removal or insertion of a cigarette.

Although it is preferred that the base support be made of relatively thin cardboard suitable for printing thereon, it may also be made of plastic material and may be foreshortened substantially depending upon the advertising material or trademark printing to be placed thereon.

We claim:

1. A package for elongated elements comprising a planar base support, a clear plastic blister form secured to said base support, said blister form forming an elongated chamber with said base support, closure means openable at one end of said package for exposing elements in said package, said blister reinforcing and spacing means on said package at spaced intervals extending outwardly therefrom to space a plurality of packages and prevent crushing of packaged elements and blister form, said blister form having a perimetrical flange secured to said base support, and a lip on said blister form at one end in juxtaposition to said reinforcing and spacing means to facilitate opening and closing said closure means.

2. A package for elongated elements as claimed in claim 1, said elongated elements being cigarettes and said closure means having a score line on said base support forming a hinge to displace a portion of said base support relative to said blister form to remove or insert a cigarette in said package.

3. A package for elongated elements as claimed in claim 1, said closure means having a score line on said base support and said blister form to provide an opening there between to remove or insert an elongated element.

4. A package for elongated elements as claimed in claim 1, said elongated chamber having means for maintaining elongated elements in spaced separated relationship therein.

5. A package for elongated elements as claimed in claim 1, wherein said blister reinforcing and spacing means extend substantially the same distance above said blister form and beyond said elongated chamber.

* * * * *